United States Patent [19]

Wood et al.

[11] Patent Number: 4,516,899

[45] Date of Patent: May 14, 1985

[54] SHEET FEEDING APPARATUS

[75] Inventors: John Wood, Southsea; Christopher M. Tinson, Rustington; Stuart M. Jenkins, Bognor Regis, all of England

[73] Assignee: De La Rue Systems Limited, London, England

[21] Appl. No.: 432,864

[22] Filed: Oct. 5, 1982

[30] Foreign Application Priority Data

Oct. 5, 1981 [GB] United Kingdom ..... 8130014

[51] Int. Cl.[3] ..... B65H 3/46

[52] U.S. Cl. ..... 414/330; 221/21; 271/258

[58] Field of Search ..... 414/114, 115, 121, 330; 221/13, 21; 271/258, 259

[56] References Cited

U.S. PATENT DOCUMENTS

| | | | |
|---|---|---|---|
| 2,132,229 | 10/1938 | Breitenstein | 221/21 |
| 2,923,434 | 2/1960 | Gabrielsen | 221/21 |
| 2,988,355 | 6/1961 | Rabinow et al. | 271/258 X |
| 3,391,806 | 7/1968 | Geis et al. | 414/330 |
| 4,110,032 | 8/1978 | Hubbard et al. | 271/258 X |

FOREIGN PATENT DOCUMENTS

| | | | |
|---|---|---|---|
| 2039264 | 8/1980 | United Kingdom | 414/330 |

*Primary Examiner*—Leslie J. Paperner

*Attorney, Agent, or Firm*—Cushman, Darby & Cushman

[57] ABSTRACT

Banknote feeding apparatus is disclosed which includes a cassette for a stack (S) of banknotes, a reciprocating suction arm (6) acting on the endmost banknote for removing banknotes singly from the end of the stack and conveying them into the nip of a pair of rollers, and which is characterized by a "gulp" arm (27) with a blade (29) which is inserted into the stack and removes from the end of the stack a batch of banknotes, conveying them into the same nip rollers. The gulp arm is coupled to the rotation of the drive shaft (21) of the suction arm (6) by means of a parallel drive shaft (23) which is driven by a drive arm (22) by means of a follower (24) only in the event of a blockage of banknotes. A blockage signal energizes a solenoid (20) which pushes the follower (24) into a position such that it will be driven by the drive arm (22), so rotating the gulp arm (27). The removal of a batch from the end of the stack should clear the blockage.

8 Claims, 10 Drawing Figures

SHEET FEEDING APPARATUS

This invention relates to apparatus for feeding sheets from the end of a stack, and is particularly useful in apparatus which dispenses banknotes from pre-loaded cassettes.

Integrated banknote handling systems are known in which security cassettes of the type described in British Pat. No. 2039264 are loaded with a stack of banknotes, and are then inserted into cash dispensing apparatus. The cash dispensing apparatus removes notes singly from the front of the cassette, i.e. the end of the stack, and delivers them to a customer in a further stack. The system used for removing single notes from the front of the cassette usually employs oscillatory suction nozzles which deliver the note into the nip of a pair of rotating rollers. This system is not sufficiently reliable, because when notes are either badly damaged or incorrectly loaded into the cassette the nozzles may fail to take a note, causing a blockage. In the event of a blockage, it is necessary to remove the cassette.

It is an object of the present invention to provide an additional system for clearing a blockage when there is a failure in the removal of single sheets from the end of a stack of sheets.

Sheet feeding apparatus according to the present invention includes a holder for a stack of sheets, and means acting on the end sheet of the stack of sheets for removing sheets singly from the end of the stack, and further includes: multiple-sheet feeding means operable to remove from the same end of the stack a batch consisting of a plurality of sheets; and means sensing the failure of the single-sheet removing means to remove a sheet from the end of the stack, and operating the multiple-sheet feeding means in response to such a failure.

In the preferred form of apparatus, the single sheet feeder is a suction feeder operating on the endmost sheet of the stack and the multiple sheet feeder includes a blade which, when the multiple sheet feeder is operated is inserted into the stack to separate from it the batch to be removed and to urge the batch out of the stack holder. The batch-feeding apparatus preferably removes a predetermined number of sheets from the end of the stack each time it is operated, and this number is preferably between 4 and 10.

When the single-sheet remover is used to deliver sheets into the nip of a pair of rotating rollers, the multiple-sheet feeder may be arranged to deliver a batch of notes into the nip of the same pair of rollers. The multiple feed is then detected later in the flow path and upon such detection the batch is outsorted.

In the preferred apparatus, the stack holder is designed to accommodate a preloaded cassette of sheets.

In order that the invention may be better understood, a preferred embodiment will now be described with reference to the accompanying drawings, wherein.

Figure 1:
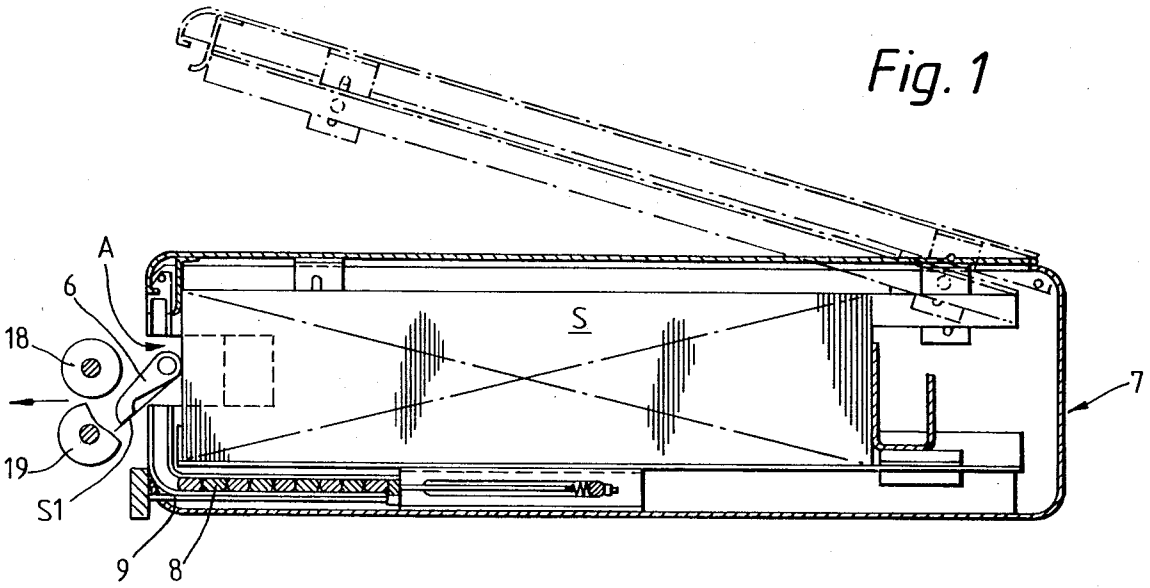
FIG. 1 is a cross-section of a pre-loaded banknote cassette together with known apparatus for picking banknotes singly from the cassette.

FIG. 1 shows a pre-loaded banknote cassette 7, of the type described in British patent application No. 2 039 264. Banknotes are stacked in a main stack S such that the endmost note S1 can be picked from the end of the main stack by oscillating suction nozzles 6 which protrude through an opening A in the end of the cassette. The end of the stack S is accessible only after the cassette 7 has been inserted into cash dispensing apparatus incorporating the single sheet picking apparatus. As the cassette is inserted into the cash dispensing apparatus, a secure shutter 8 is slid by a pin 9 away from the end of the cassette to reveal the opening A. When a single sheet S1 has been picked from the end of the stack, it is delivered to the lower roller 19 of a pair of nip rollers 18 and 19. As the nip rollers rotate, the end of the sheet is drawn into the nip and is finally separated from the stack S.

Figure 2:
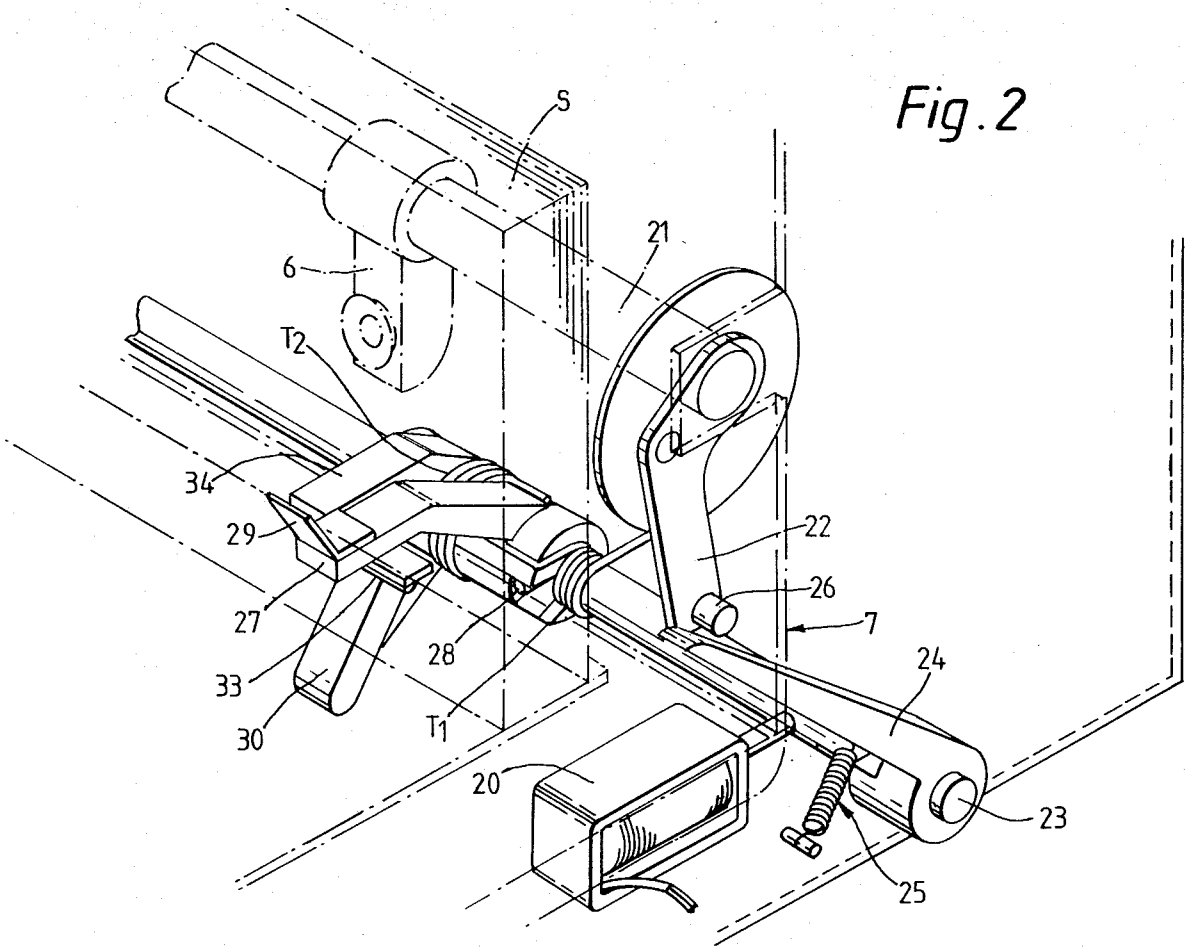
FIG. 2 is a perspective view of feeding apparatus in accordance with the preferred embodiment of the invention.

FIG. 2 ilustrates apparatus according to the preferred embodiment of the invention for removing a small stack of the endmost notes of the main stack, in the event of a blockage of the single sheet picking apparatus. If the blockage was due to the cassette having been incorrectly loaded, it is probable that by rejecting the endmost notes in this way the blockage will be cleared. This method should also clear from the end of the stack badly damaged notes which the suction nozzles fail to pick up.

The failure of the cash dispensing apparatus to pick up a sheet from the end of the stack of sheets is detected by a sensor (not shown) along the delivery path of the note from the cassette. A signal from the sensor indicating a blockage energises a solenoid 20, shown in FIG. 2, which causes the multiple feeding apparatus of the invention to operate. FIG. 2 shows details of the banknote feeding apparatus of a cash dispensing machine containing a pre-loaded cassette 7 with a stack S of banknotes. One of the reciprocating suction nozzles 6 is shown in dotted lines. A shaft 21 for driving the suction nozzles also operates to drive a drive arm 22. A parallel shaft 23 is driven by the drive arm 22 by means of a follower 24 only in the event of a blockage of banknotes. A blockage signal energises the solenoid 20 which pushes the follower 24 into a position where it will be driven by the drive arm 22.

Figure 3:
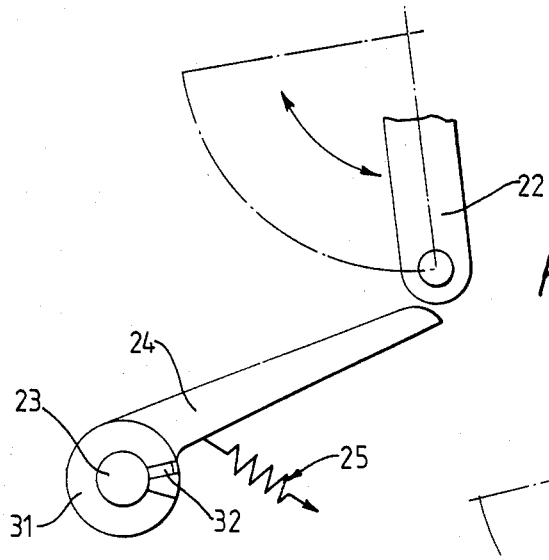
FIGS. 3 to 5 illustrate successive stages of the operation of the feeding apparatus of FIG. 2.
Figure 4:
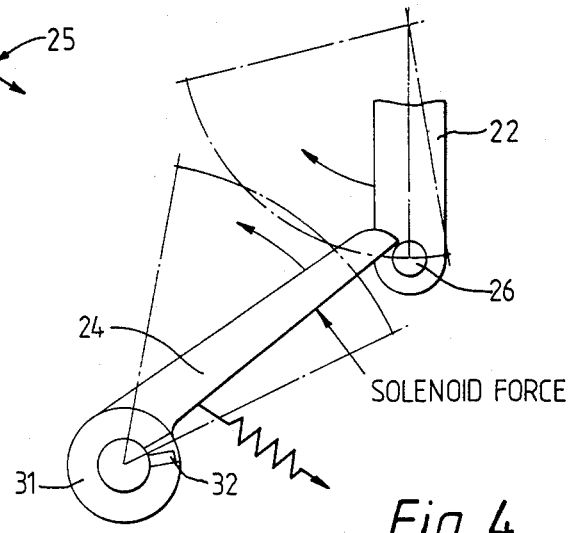
Figure 5:
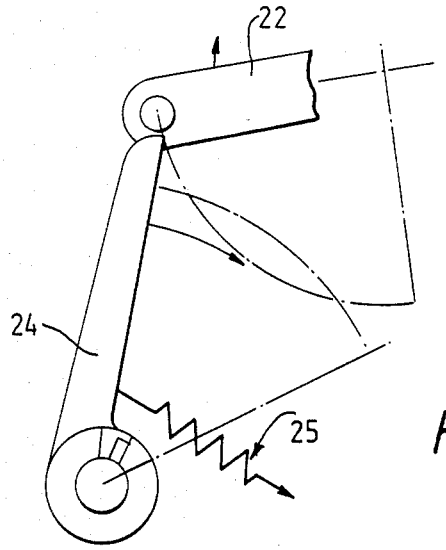

The manner in which the rotation of drive shaft 5 is effected by the motion of the suction nozzle shaft is illustrated in FIGS. 3, 4 and 5. In the absence of a blockage signal, the follower 24 is maintained in a rest position (FIG. 3) by a spring 25, whereby the reciprocating motion of the drive arm 22 has no influence on the shaft 23. When a blockage is signalled, the solenoid exerts a force to rotate the follower 24 clockwise in FIG. 2, and anti-clockwise in FIG. 3, so as to position the end of the follower 24 in the path of a pin 26 at the end of the drive arm 22. The follower 24 is now in its working position (FIG. 4) such that the next rotation of the suction nozzle shaft (clockwise in FIG. 4) will drive the follower and the shaft 23 (anti-clockwise in FIG. 4). The drive arm 22 rotates through approximately 90°, and at the end of this arc of rotation the follower 24 disengages from the drive arm 22 (FIG. 5) to be returned to its original position by the action of the return spring 25.

The rotation of drive shaft 23 causes the separation and removal of a "reject batch" consisting of the end-most notes in the stack. This batch is conveyed away from the cassette in place of a single banknote, thus clearing the blockage. This process of clearing a blockage by feeding a batch of banknotes will be referred to as a "gulp". A "gulp arm" 27 with a blade 29 on its end is driven by a pin 28 located in the shaft 23. This is shown more clearly in FIGS. 6 to 8. During the operation of the "gulp", the gulp arm 27 rotates clockwise forcing the blade 29 into the stack of banknotes in the cassette, separating the "reject batch" from the main stack of banknotes. The number of banknotes constituting the reject batch may vary slightly in a series of "gulp" operations, but in the preferred embodiment is designed to be around 5 banknotes. It is possible to vary the number of banknotes in the reject batch by altering the horizontal position of the blade on the gulp arm 27 relative to the position of a cassette when it is inserted into the cash dispensing apparatus.

Figure 6:
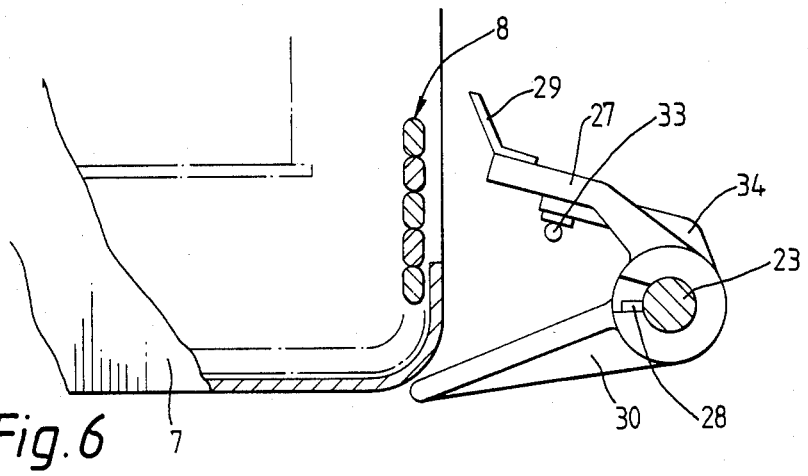
FIGS. 6 to 8 show successive stages of the insertion of a cassette of banknotes into the apparatus of FIG. 2.
Figure 7:
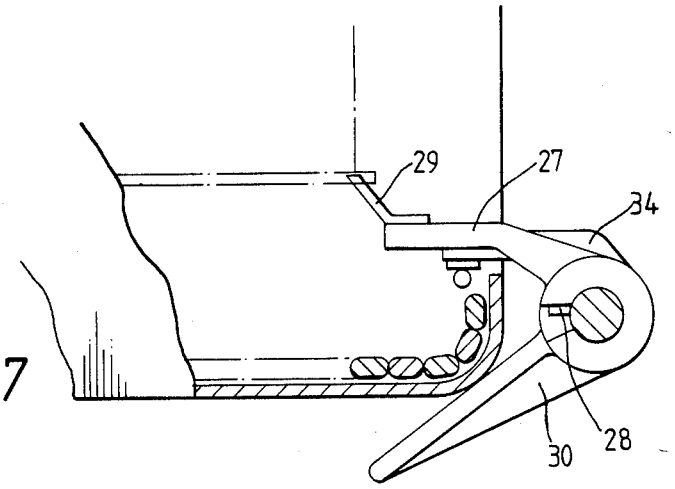
Figure 8:
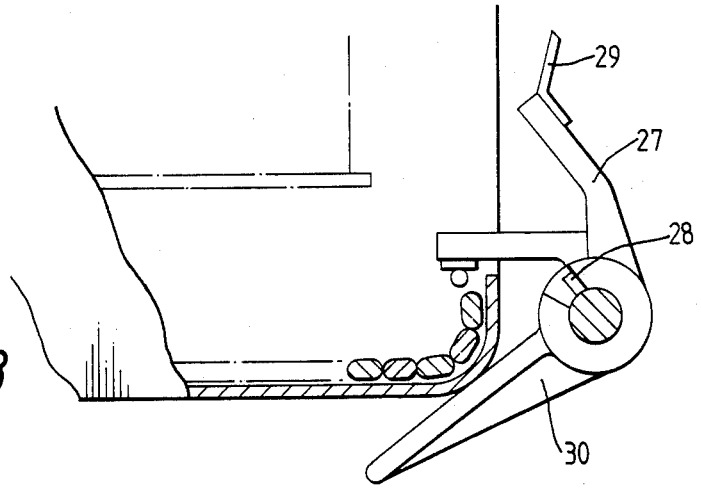

FIG. 6 shows the feeding apparatus together with an end portion of a cassette of banknotes, just before the cassette has been fully inserted into the cash dispensing apparatus. The insertion of the cassette causes the shutter 8 to slide downwards and backwards into the wall of the cassette into a position such as is shown in FIG. 7. Simultaneously, a positioning arm 30 engages with the bottom corner of the cassette, and rotates anti-clockwise to cause the gulp arm 27 to be positioned adjacent to the stack of banknotes within the cassette (FIG. 7). During the rotation of the follower 24 to its working position (FIG. 7), under the drive of the solenoid 1, the gulp arm 27 is not driven because of a degree of free play between a sleeve 31 attached to follower 24 and a driven pin 32 on shaft 23 (FIGS. 3 to 5). On the further clockwise rotation of shaft 23 by the drive arm 22 through follower 24, the gulp arm 27 is rotated clockwise (FIG. 8), the blade then separating the end batch of notes and delivering it into the nip of the feed rollers (FIG. 1).

The gulp arm 27 and positioning arm 30 are held in their pre-loaded rest position by a torsion spring T1 (FIG. 2) located on shaft 23. A second torsion spring T2 located between the positioning arm 30 and the gulp arm 27 is used to hold the arms together and to act as a return spring. The action of loading the cassette pushes the positioning arm 30 downwards, and as the force exerted by the spring T2 is greater than that exerted by spring T1 the gulp arm 27 is pulled into its working position.

In one form of apparatus, the positioning arm 30 also carries a reed switch 33 on a second arm 34 attached rigidly to the positioning arm 30. The reed switch 33 is activated by a magnet at the base of a banknote packer plate which compresses the rear end of the main stack (on the right in FIG. 1). The packer plate moves forward (left-wards in FIG. 1) as the cassette is emptied, and the magnet moves closer to the reed switch 33. The switch 33 is designed to activate when the cassette has run so low that the operation of the gulp arm 27 would damage the apparatus. The activation of the reed switch 33 therefore inhibits the gulp operation, preventing the arm 27 from damaging itself against the packer plate.

In a preferred form, however, the banknote packer plate is formed with a slot through which the gulp arm 27 is able to pass unimpeded when the packer plate is close to the front of the banknote cassette. Thus even when the cassette is empty or nearly empty, the arm 27 is prevented from damaging itself; and the inhibit mechanism responsive to the reed switch is unnecessary.

Although the preferred embodiment of the invention, as described above, delivers the reject batch into the nip of the same nip rollers as are used for the normal delivery of single banknotes, it would be possible to provide independent apparatus for delivering the reject batch to a reject station remote from the cassette. It is also unnecessary to provide a mechanical link between the reciprocating motion of the suction nozzle shaft and the shaft 23; the gulp arm 27 could be driven independently of the rotation of the suction nozzle shaft.

Banknote dispensing apparatus generally dispenses banknotes of more than one denomination, and each denomination requires a separate cassette together with its associated feeding mechanism. Each feeding mechanism comprises means for delivering single banknotes and a "gulp" mechanism for delivering a batch of banknotes, as described above. Each drive shaft 21 for the suction feeder 6 and the drive arm 22 is rotated by means of a feed solenoid. Each gulp solenoid 20 is operative only in the event that a gulp is required. Thus for each normal feeding operation only the feed solenoid is energised, but for a gulp operation both solenoids are energised.

Figure 9:
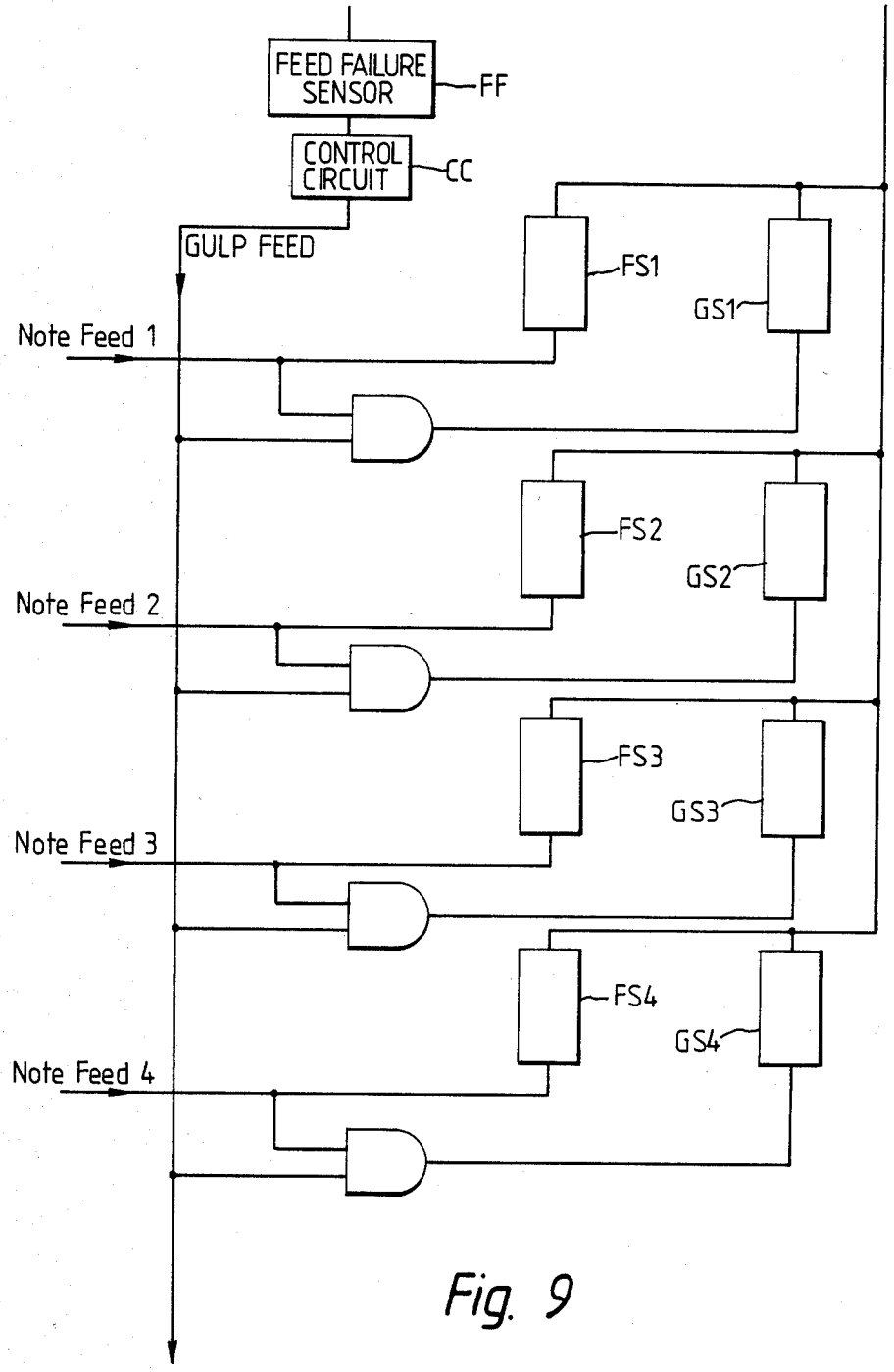
FIG. 9 is a diagram indicating the manner in which control signals for four parallel sets of feeding apparatus activate the feeding mechanisms.

FIG. 9 is a circuit diagram showing how the feed and gulp solenoids are energised in response to control signals. In this example there are four sets of sheet feeding apparatus operating in parallel. Whenever a note of a particular denomination is required, a "note feed" signal is supplied to the relevant sheet feeding apparatus, causing the relevant feed solenoid to be energised. If after a note feed signal, the single note feeding apparatus fails to remove a single note, then a feed failure sensor FF detects that no note has passed, and a control circuit (CC) provides a gulp feed signal. The sensor may be placed in a path common to all denominations of banknotes, so that only one sensor is required. The note feed signal for the relevant denomination is still present when the gulp feed signal is produced, so that a series of four AND gates applies the gulp feed signal only to the relevant gulp solenoid. If any of the four AND gates receives both a note feed signal and a gulp feed signal then it causes its own gulp solenoid to be energised. In FIG. 9, the feed solenoids are labelled FS1 to FS4 and the gulp solenoids are labelled GS1 to GS4.

Figure 10:
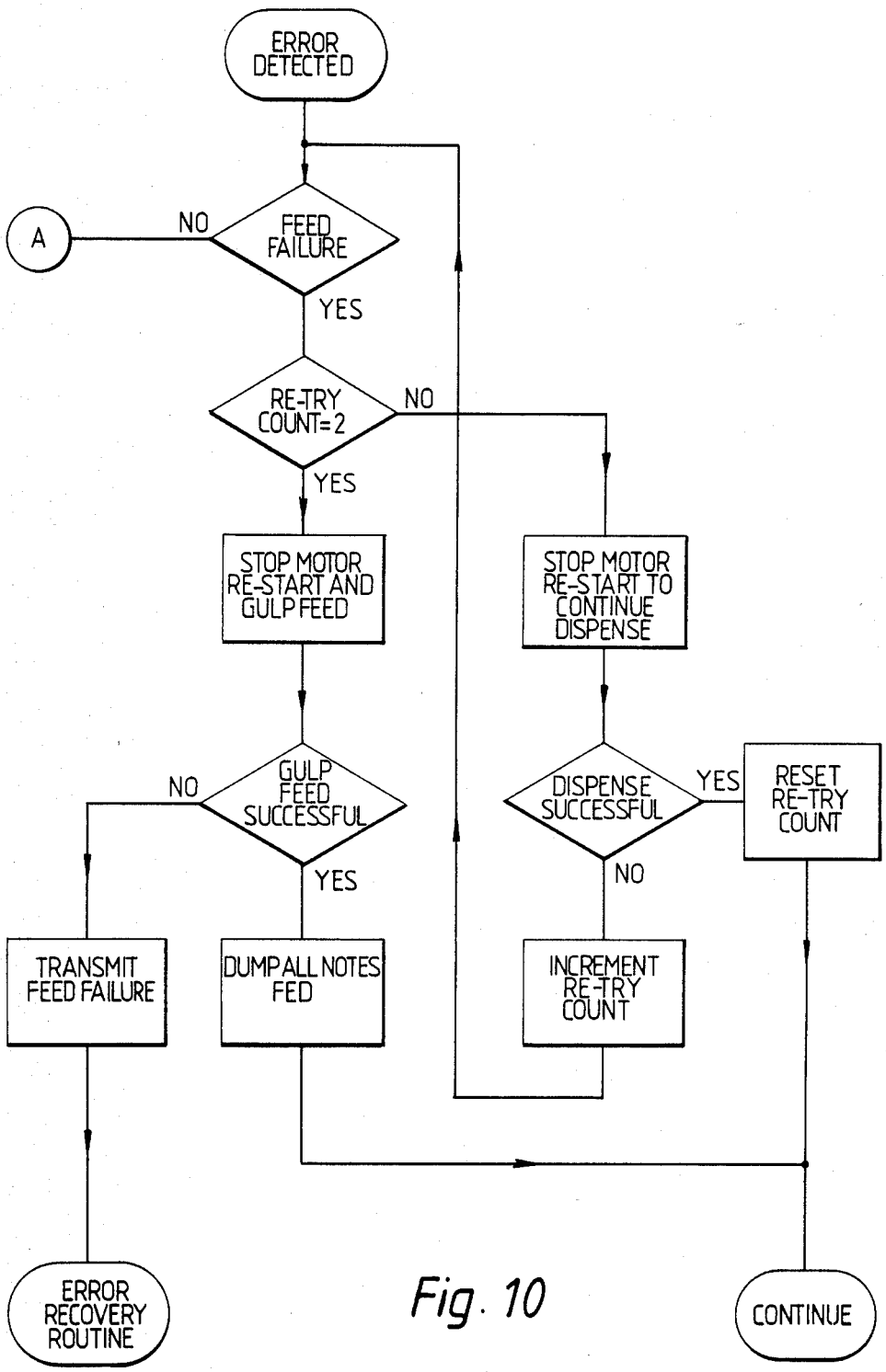
FIG. 10 is a flow diagram for decisions made following the failure of the feeding apparatus to deliver a single banknote.

FIG. 10 is a flow diagram illustrating the operation of a control circuit for the operation of the banknote feeding mechanisms. When an error is detected during the normal running of the banknote feeding apparatus, the control circuit first establishes whether the error was caused by a banknote feed failure, or whether for example it was due to an incorrect request by a banknote teller. If the error was not due to a failure in the feed mechanism, then further processes are carried out (at A), which need not be described here. In the event of a feed failure, indicated at least in part by the sensor in the banknote feed path described above, then the control circuit causes the single banknote feeding mechanism to make two further attempts at removing a single banknote. These attempts are counted, the stored count being the "re-try count". The re-try count is initially set at zero. Assuming the re-try count is not yet equal to 2, a motor for delivering banknotes once they have been fed from the cassette is first stopped and then re-started in order to continue with the dispensing operation. The control circuit then tests to see whether this new attempt at dispensing was successful. If so, the re-try count is reset to zero and the apparatus proceeds in the normal manner. If not, the re-try count is incremented by one, and the routine is commenced once again by testing whether the failure was due to an incorrect feed.

When the re-try count reaches 2 and there has still been an error due to a feed failure, then the motor is stopped and restarted and a gulp feed signal is supplied to the apparatus of FIG. 9. After this attempt at a gulp feed, the control circuit tests to see that the gulp feed was successful. If not, the control circuit transmits a signal indicative of a feed failure and an error recovery routine is entered; the error recovery process need not be described here. If the gulp feed was successful then all the banknotes that were fed are dumped, and the apparatus is caused to continue normally.

Although the invention has been described with reference to a stack of banknotes contained in a cassette, the "gulp" mechanism is equally applicable to any stack of sheets which are normally fed singly from the stack but which are subject to blockage.

We claim:

1. Sheet feeding apparatus including a holder for a stack of sheets, and means acting on the end sheet of the stack of sheets for removing sheets singly from the end of the stack, and further including:

multiple-sheet feeding means which remove from the same end of the stack a batch consisting of a plurality of sheets; and means sensing the failure of the single-sheet removing means to remove a sheet from the end of the stack and operating the multiple-sheet feeding means in response to such a failure, said multiple-sheet feeding means including a blade which, when the multiple-sheet feeding means is operative, is inserted into the stack to separate it from the batch to be removed and to urge the stack out of the stack holder.

2. Apparatus in accordance with claim 1, in which the single-sheet removing means is a suction feeder operating on the endmost sheet of the stack.

3. Apparatus in accordance with claim 1, in which the multiple-sheet feeding means is adjustable to allow the number of sheets to be removed from the stack to be varied.

4. Apparatus in accordance with claim 1 comprising a driving means for the single-sheet removing means, and in which the multiple-sheet feeding means, in the event of failure of the single-sheet removing means to remove a sheet, is driven by the driving means for the single sheet removing means.

5. Apparatus in accordance with claim 4, in which the multiple-sheet feeding means comprises:

a follower movable into the path of a device connected to the driving means for the single-sheet removing means;

a solenoid responsive to a signal from the sensing means, indicative of the failure of the single-sheet removing means to remove a sheet, to move the follower into the said path; and a batch separator linked to the follower, whereby the separator enters the stack when the follower is driven by the said driving means and separates and removes the said batch from the end of the stack.

6. Apparatus in accordance with claim 1, comprising a pair of rollers positioned to receive sheets delivered by the single-sheet removing means, and in which the same rollers receive a batch of sheets when the multiple-sheet feeding means operates.

7. Apparatus in accordance with claim 1, in which the stack holder is a cassette which includes a spring-loaded packer plate at the trailing end of the stack, and wherein the packer plate is formed with a slot to enable the multiple sheet feeding means to remove a batch of sheets unimpeded by the packer plate, when the stack is nearly empty.

8. Sheet feeding apparatus comprising a holder for a stack of sheets having a sheet outlet, and single-sheet removing means including a suction feeder acting on an end sheet of the stack for removing sheets singly from that end through the sheet outlet and further comprising:

means sensing the failure of the single-sheet removing means to remove a sheet from the end of the stack and providing a failure signal; and multiple-sheet feeding means including a member movable independently of the operation of the single-sheet feeding means in response to the failure signal to urge a batch consisting of a plurality of sheets from the same end of the stack through the sheet outlet.

* * * * *

UNITED STATES PATENT AND TRADEMARK OFFICE

CERTIFICATE OF CORRECTION

PATENT NO. : 4,516,899

DATED : May 14, 1985

INVENTOR(S) : John Wood, Christopher M. Tinson, Stuart M. Jenkins

It is certified that error appears in the above-identified patent and that said Letters Patent is hereby corrected as shown below:

Column 5, line 36, delete "stack" first occurrence and substitute therefor -- batch --.

Signed and Sealed this

*Tenth* Day of *December 1985*

[SEAL]

*Attest:*

DONALD J. QUIGG

*Attesting Officer*

*Commissioner of Patents and Trademarks*